United States Patent [19]

Powell

[11] 4,282,903

[45] Aug. 11, 1981

[54] STEAM CLEANING MACHINE

[75] Inventor: Charles A. Powell, Oxford, Fla.

[73] Assignee: National Power Corporation, Wildwood, Fla.

[21] Appl. No.: 11,941

[22] Filed: Feb. 13, 1979

[51] Int. Cl.[3] ..... F05B 1/24; B08B 3/00

[52] U.S. Cl. ..... 137/893; 60/39.46 M; 134/102; 137/899.4; 239/139

[58] Field of Search ..... 122/16–17, 122/19, 136 R; 134/102; 60/39.46 M; 137/351, 604, 893, 899.4; 239/135, 139

[56] References Cited

U.S. PATENT DOCUMENTS

| | | | |
|---|---|---|---|
| 140,220 | 6/1973 | Scheide | 60/39.57 |
| 1,676,842 | 7/1928 | Smallhouse | 239/135 |
| 1,797,584 | 3/1931 | O'Neill | 239/135 |
| 2,858,162 | 10/1958 | Frank | 239/129 |
| 2,981,250 | 4/1961 | Stewart | 122/31 |
| 2,984,419 | 5/1961 | McOuct | 239/129 |
| 2,987,259 | 6/1961 | Lindquist | 239/139 |
| 3,103,312 | 9/1963 | Damrow | 134/102 |
| 3,141,615 | 7/1964 | Waldron, Jr. | 239/129 |
| 3,230,707 | 1/1966 | Rothmayer et al. | 60/39.46 M |
| 3,447,316 | 6/1969 | White | 60/39.46 M |
| 3,447,645 | 11/1969 | Murphy | 239/129 |
| 3,448,924 | 6/1969 | Congdon | 239/129 |
| 3,568,658 | 3/1971 | Brock | 126/360 |
| 3,575,349 | 4/1971 | Stahl | 239/135 |
| 3,669,079 | 6/1972 | Black | 122/136 R |
| 3,814,321 | 6/1974 | Mulholland | 239/135 |
| 4,059,123 | 11/1977 | Bardos et al. | 134/102 |

*Primary Examiner*—Martin P. Schwadron
*Assistant Examiner*—A. Michael Chambers
*Attorney, Agent, or Firm*—Irvin A. Lavine

[57] ABSTRACT

A steam cleaning machine comprises a steam generator system including a tank for fuel, such as propane, a detergent tank, and connections to sources of air under pressure and water. A hand-held steam generator unit includes a central combustion chamber spaced inwardly of a surrounding jacket. A first conduit extends to the rear of the combustion chamber, carrying a combustible gas-air mixture. A water conduit extends to the rear of the jacket. The chamber has a spark plug extending into it, through the jacket, and the forward end of the combustion chamber has an axial exhaust pipe, surrounded by a steam discharge pipe connected to the outlet of the jacket. Downstream of the combustion chamber outlet pipe is a detergent inlet connected by a conduit to the detergent tank.

16 Claims, 4 Drawing Figures

STEAM CLEANING MACHINE

BACKGROUND OF THE INVENTION

The present invention relates to a steam generator system, for use as a steam cleaning machine, particularly in the automotive field, and in the agricultural field.

In the automotive field, trucks and automobiles accumulate grease and dirt, particularly on the engine, where a thick oil-laden covering accumulates. This material is removed by discharging a jet of steam, sometimes mixed with detergent, onto it from a steam cleaning machine. The presently used steam cleaning machines have a number of deficiencies, so that they are often not satisfactory. In the agricultural field, animal pens have been cleaned by water under pressure.

Steam generators, for use in steam cleaning operations in the automotive field, such as in filling stations and garages, were typically provided with a source of heat, such as a kerosene burner, supplied from a kerosene tank. The exhaust gases from the kerosene burner were driven, sometimes by a blower, through a water-coil. Water was fed to the water coil either from a connection to a water main, or from a water tank, being driven by a pump. Into the conduit from the water pump to the water coil, a connection was made to a detergent tank, so that there was supplied to the water coil either water, or water and detergent. The outlet of the steam coil was connected to a hand-held nozzle construction, so as to direct the steam. This equipment required, in a typical example, a pair of electric motors, one to drive the water pump, and a second to drive the kerosene pump, and, optionally, a blower for the kerosene burner. These electric motors were powered from a typical 110 volt supply source, to which the apparatus was connected by an extension cord.

The above described apparatus was expensive, unreliable, and dangerous. Because of the number of components, it was expensive to build such machines and to market them. The machines themselves were subject to non-functioning, due in part to the fact that they had moving parts such as pumps and motors, and due in part to the fact that after a period of use, particularly in areas where the water had a high mineral content, deposits within the conduits tended to restrict and/or block the flow through the conduits. Further, such machines were often moved about a shop, such as an automotive repair shop, where the extension cord sometimes lay on a floor where water was present; if, after a period of use the extension cord insulation became worn, exposure of the electric conductor wires resulted, and these if in contact with water on the floor of the shop, could cause dangerous electrical shock to personnel, and could also create a fire. In addition, the steam cleaners of the above type required a long start-up period, perhaps five minutes from a cold start, and were unduly heavy, weighing approximately 300–400 pounds.

Other constructions of steam generator systems for use as steam cleaners in the automotive field have been suggested. For example, Murphy, U.S. Pat. No. 3,477,645 discloses such an apparatus in which a central chamber is provided for receiving a pyrotechnic cartridge, such as a road fare. The combustion chamber is surrounded by a jacket, and a connection is provided to introduce water into the jacket, where the water is heated into steam, an exhaust pipe from the chamber for the flare being located concentrically within a steam discharge pipe. This construction could only be used for a short period of time, before a flare had to be replaced, required clean out of residue from the combustion chamber, required the insertion of a burning flare into the unit, with some attendent danger, had no provision for the delivery of detergent, and no provision for the delivery of either an air and water mixture, for flushing, or an air mixture alone, for drying.

Another suggestion for the cleaning of engines is found in Mc Ouat, U.S. Pat. No. 2,984,419, wherein the source of energy for the system was the exhaust of an automobile or similar internal combustion engine. This provided an undue expense in operation, and apparently could not generate steam for cleaning purposes.

Various proposals have been made for the generation of fog or aerosol, these being equipments used in insect control and related agricultural purposes. For example, Congdon, U.S. Pat. No. 3,448,924 discloses a fog generating apparatus utilizing a pulse jet engine supplied from a gas tank such as propane or butane. A valve is provided which admits a fuel-air mixture into the combustion chamber intermittently. Waldron Jr., U.S. Pat. No. 3,141,615 discloses a fogger including a combustion engine with a spark plug which is intermittently fired, the engine being fed with fuel and air separately, liquid being delivered to the outside of an engine exhaust pipe, where it is vaporized to produce the fog which is conveyed outwardly by the engine exhaust. Stahl et al., U.S. Pat. No. 3,575,349 discloses a fog apparatus including a combustion chamber which is fed by liquid fuel and air from a carbuerator. The engine fires intermittently, or in pulses, and various liquid materials may be introduced into the exhaust for discharge with the exhaust. Frank, U.S. Pat. No. 2,858,162 discloses an aerosol generator wherein a pulse jet engine is utilized, with provision for introduction of liquid into the engine exhaust pipe. In all of these fog or aerosol generators, the discharge is of relatively low velocity, low pressure, and is therfore not suitable for steam cleaning purposes.

Broadly speaking, the generation of steam by so-called submerged combustion has long been known, as exemplified by Scheide, U.S. Pat. No. 140,220, Stewart, U.S. Pat. No. 2,981,250, and Brock U.S. Pat. No. 3,568,658.

SUMMARY OF THE INVENTION

The present invention provides a steam cleaning machine which in a different embodiment is useable in such distinct environments as the automotive field and the agricultural field. The steam cleaning machine includes a hand-held steam generator unit, supplied with fluids from a fluid supply system having such components as needed. For the automotive field, the fluid supply system includes a fuel tank, such as propane, a tank for liquid detergent, and connections to an existing water main and to an air pressure system. Where the steam cleaning machine is to be used in an agricultual environment, a carrier may be provided on a tractor, with an air compressor driven from the tractor power takeoff, and delivering compressed air to a compressed air storage tank. If water is not available, a water storage tank may be provided, and other tanks, for holding, for example, other materials, may also be provided.

In both fluid supply systems, a branch from the air conduit is connected to the detergent tank, so as to pressurize it. The fuel tank such as propane has an outlet provided with an on-off valve, a pressure regulating valve, and a check valve. A discharge from the check valve of the fuel in gaseous form is introduced into the air conduit, and the air conduit, as well as the water conduit, are connected to the hand-held steam generator unit by flexible hoses. A flexible hose also connects the outlet of the detergent tank to the hand-held steam generator unit.

The hand-held steam generator unit has a central combustion chamber, and a surrounding, spaced jacket. The combustion chamber has an axial exhaust pipe, and is of relatively short length, while the jacket has a discharge pipe in surrounding relationship to the exhaust pipe, and is of considerable length. The detergent hose is connected into the discharge pipe, downstream of the air combustion chamber exhaust pipe. The combustion chamber has an inlet pipe opposite the exhaust pipe, and a mounting tube for a spark plug is connected to the combustion chamber intermediate its ends, and extends through the jacket, and a spark plug is positioned in the mounting tube. A water inlet pipe is connected to the rear of the jacket. An electric potential is applied to the spark plug, and initiating combustion, after which the combustion in the combustion chamber is self-sustaining.

Among the objects of the present invention are to provide a steam cleaning machine for use in the automotive, agricultural, and other fields, which are reliable, able to function for long periods of time without adjustment or maintenance and without clogging, has a steam generator unit without moving parts such as pumps and motors, is lightweight and of simple construction and operation, can be started and operated within a short time, can operate continuously for a long period of time, is safe to operate and does not require the handling of flares and does not require connection to an electrical outlet, and has many optional uses. Other objects are to provide a steam cleaning machine with which steam may be generated with or without a detergent content, where air may be discharged with or without water, and wherein water alone may be discharged.

Other objects and many attendant advantages of the invention will be readily understood from the following specification, claims and drawings.

DESCRIPTION OF THE PREFERRED EMBODIMENT

Figure 1:
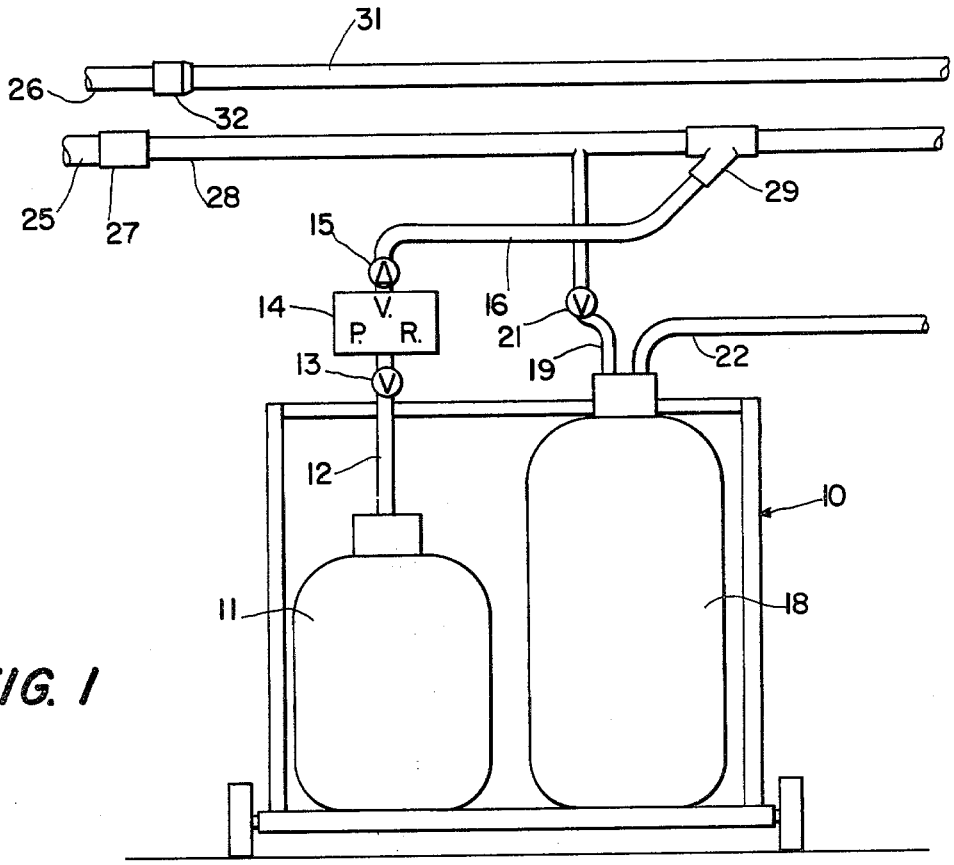
FIG. 1 is an elevational view, with some parts shown schematically, of a fluid supply system forming a part of the present invention.

Referring now to the drawings, wherein like or corresponding reference numerals are used to designate like or corresponding parts throughout the several views, there is shown in FIG. 1 the fluid supply portion or system of the present invention, and including, for convenience, a wheeled carrier 10, supporting a fuel tank 11 which may contain, for example, propane, in liquid form. The propane tank 11 is conventional, having an outlet conduit 12, in which are a control valve 13, a pressure regulating valve 14, and a check valve 15. Connected to the check valve 15 is a conduit 16.

Also mounted on the wheeled carrier 10 is a tank 18 containing detergent in liquid form, the tank being of known construction, and having an inlet conduit 19 in which there is a valve 21, and having, also, an outlet conduit 22.

There is shown an air pressure line 25 which may be a part of the air pressure supply system within a filling station or garage, and there is also shown a water main or faucet 26, connected to the municipal water supply system. Connected to the air supply line 25 by a connector 27 is a pressurized air conduit 28, the conduit 28 having connected to it the aforementioned conduit 19, by conventional coupling means, not shown. The conduit 16, supplying the gaseous fuel from fuel tank 11 is connected to the pressurized air conduit 28, as by a connector 29, so that downstream or to the right of connector 29 the conduit 28 will carry a mixture of air and fuel.

The water main 26 has a water conduit 31 connected to it by a suitable coupling member 32.

Figure 2:
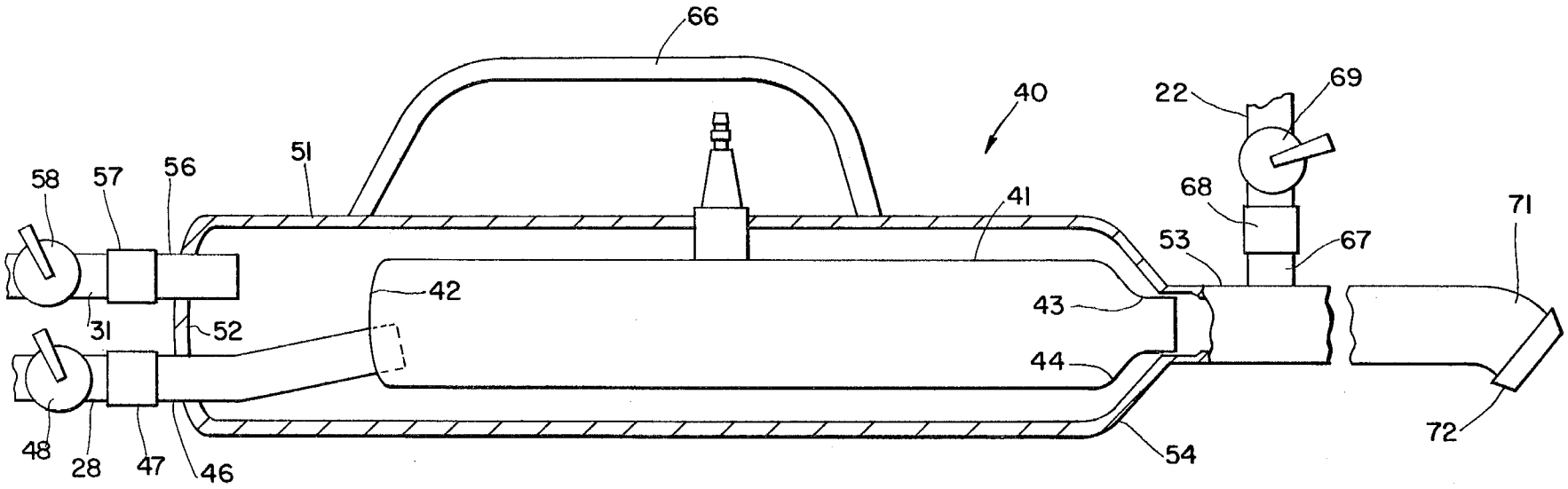
FIG. 2 is a cross-sectional view, with parts broken away, of a hand-held steam generator unit forming a part of the present invention.

The conduits 22, 28 and 31 are shown broken away in FIG. 1, and it will be understood that these conduits may be of any convenient length, and are, at least in part, flexible, so as to provide a flexible connection between the structures as shown in FIG. 1 and the hand-held steam generator unit shown in detail in FIG. 2.

Referring now to FIG. 2, a steam generator unit 40 comprises a combustion chamber 41, which is of elongate shape, and in cross-section is preferably circular. The combustion chamber 41 is made of heat conducting material, such as metal, and has a closed end 42 and at its opposite end, an exhaust pipe 43. Exhaust pipe 43 is axially extending, and is of smaller diameter than the combustion chamber 41, being connected thereto by a necked down portion 44. The exhaust pipe 43 is, as shown, of relatively short length in comparison to the combustion chamber 41. Extending through the closed wall 42 of combustion chamber 41 is a pipe 46 which receives a combustible mixture of gas and air, supplied through conduit 28, conduit 28 being connected to pipe 46 by a coupling 47 and being provided with a valve 48 for regulating the flow of the mixture, so that the amount of mixture may be controlled or so that the flow can be stopped, entirely.

A jacket 51 is positioned in spaced, surrounding relationship to the combustion chamber 41, and like the combustion chamber 41 is elongate, preferably of circular transverse cross section, the spacing between the interior of the jacket 51 and the exterior of the combustion chamber 41 providing a heating space for the heating of water introduced thereinto. The jacket 51 is provided with a closed end 52 adjacent and spaced from the closed end 42 of combustion chamber 41. At its opposite end, the jacket 51 has an axial discharge pipe 53, which is necked down as shown at 54, and is in surrounding relationship to the exhaust pipe 43; however, the discharge pipe 53 extends well beyond the relatively short exhaust pipe 43. A water inlet pipe 56 extends into the rear of the jacket 51, preferably through the end wall 52, and is connected to the water conduit 31 by a coupling 57. Conduit 51 may have therein a valve 58, to control the volume of water delivered into the space within the jacket 51.

Figure 3:
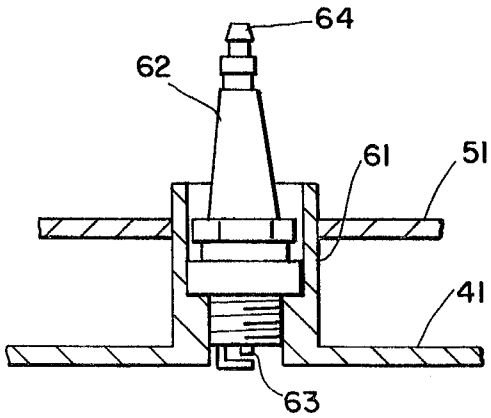
FIG. 3 is a cross-sectional view of a detail of the construction shown in FIG. 2.

Referring now to FIG. 3, there is shown a mounting tube 61 extending from combustion chamber 41 outwardly, and through the jacket 51. Mounting tube 61 is preferably hermetically secured, or bonded, to both the combustion chamber 41 and jacket 51, and is internally threaded, so as to receive a standard spark plug 62, having conventional electrodes 63 which are located within or in operative association with the interior of the combustion chamber 41. The spark plug 62 has the conventional terminal 64 at its outer end, by which means upon the application of electrical energy thereto, a spark will be discharged between the electrodes 63 in the normal manner.

A handle 66 is provided, being attached to the jacket 51, so as to enable the steam generator unit 40 to be hand-held.

Connected to the discharge pipe 53 is an inlet pipe 67, to which is connected the detergent conduit 22 by a conventional coupling 68. A valve 69 is provided in order to control and to regulate the amount of detergent discharged into the pipe 53 from inlet pipe 67. As will be observed, the inlet pipe 67 is spaced substantially from the end of the exhaust pipe 43. The discharge pipe 53, for convenience, has a down-turned end 71, on which is positioned, optionally, a suitable discharge nozzle 72.

To supply electrical energy to the spark plug 62, use may be made of an energy source, preferably a small, hand-held energy source which may be temporarily attached to, and therefore detachable from, the terminal 64 of spark plug 62. One example of such a device is a piezo electric ignitor, produced by Vernitron Piezo Electric Division, Vernitron Corporation, Bedford, Ohio.

In operation, assuming that conduits 28 and 31 are appropriately connected to the air pressure system and water supply which are conventionally found in a filling station, garage, or the like, and that all conduits are connected as herein disclosed, valve 21 is opened to pressurize the detergent tank 18, and valve 13 is opened in order to permit fuel to flow from the fuel tank 11. A mixture of fuel and air will then flow through conduit 28, and enter the combustion chamber. Upon association of an electrical potential generator with the spark plug 72, a spark will ignite this combustible mixture in combustion chamber 41, and the valve 58 will be opened to admit water into the space between the jacket 51 and the combustion chamber 41. The water will receive heat from combustion chamber 41 as it travels the length of the noted space, and will then flow outwardly through the discharge pipe 53, being additionally heated by direct contact of the combustion gasses issuing from exhaust pipe 43. Combustion within the combustion chamber 41 will be continuous, even after removal of the electrical potential generator, so long as the combustible mixture is supplied through pipe 46. The velocity and force of the issuing steam will be substantial, sufficient to loosen and flush aways accumulations of oil and dirt such as occurs on engines and other parts of automotive vehicles, and on the floor of a garage. Where desirable, the valve 48 may be regulated so as to change the temperature of the steam, and, also, the valve 58 may be regulated to adjust the amount of incoming water, so as to adjust the character and quality of the issuing steam. In addition, detergent may be added to the issuing stream by manipulation of the valve 69, so that detergent may be added, if desired, and in a selected amount.

Different cleaning tasks, or different stages of the same cleaning task, often require different fluids, or different qualities of fluids. Therefore, as above noted, the character and quality of the issuing steam may be regulated by regulating the water control valve 58 and the mixture control valve 48. If desired, the control valve 48 may be closed, so that only water, or water and detergent may be discharged. Alternatively, by closing the valve 13, there will be no combustion, but air may be discharged from nozzle 72, after passing through combustion chamber 41, and this air may or may not have water mixed with it, dependent upon the position of the water control valve 48. In either mode, it may be desirable to discharge detergent, and this, also may be accomplished.

The herein disclosed apparatus requires a minimal warm up time, being operational in, for example, only 10 seconds. The weight of the entire apparatus disclosed in FIGS. 1–3 is approximately 125 pounds; the steam generating unit 40 has a length from the end wall 52 to the end of the exhaust pipe 43 of about 13 inches, the combustion chamber 41 having an inside diameter of 1 inch, and the jacket 51 having an inside diameter of $1\frac{1}{2}$ inches, in a preferred embodiment.

Figure 4:
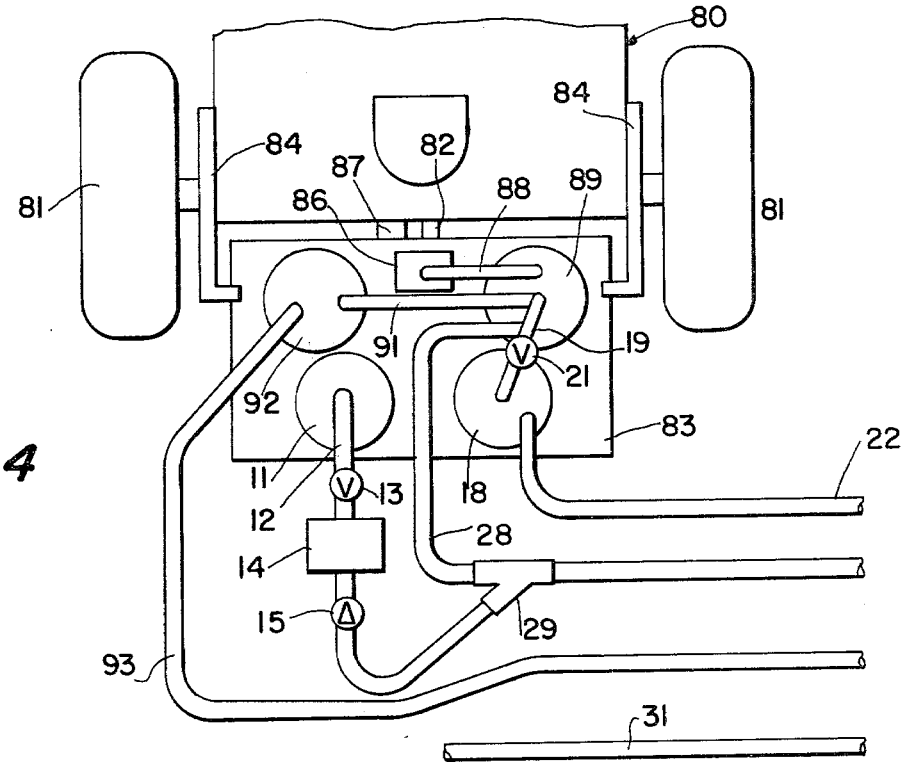
FIG. 4 is a schematic view of a tractor having the fluid supply system of the present invention mounted thereon.

For some tasks, the fluid supply system may be modified, as required. For example, in the agricultural field, animals, such as hogs, are kept in pens, where refuse material must be flushed away for cleanliness. Hog farms have water under pressure available at the pens, but not air under pressure. As shown in FIG. 4, an alternative embodiment of the fluid supply system is shown, in association with a portion of a tractor, the tractor being designated 80, and having wheels 81 at its rear, and a power take-off shaft 82. A platform 83 is supported by lift arms 84, and an air compressor 85 is driven by a conventional connection 87 from the power take-off shaft 82. A conduit 88 delivers air to a compressed air storage tank 89. Suitable controls of conventional construction, not shown, are provided in association with the compressed air storage tank 89, so as to stop the delivery of compressed air thereto, upon the buildup of pressure to a predetermined level. A discharge conduit 28 leads from the compressed air storage tank 89, having a branch 18, with valve 21, leading to a detergent tank 18, having a discharge conduit 22. A further branch 91 of the compressed discharged conduit leads to a tank 92, having a discharge conduit 93 connected to it. The tank 92 may hold a liquid such as a deodorant, which may be delivered either directly to the steam generator unit 40, or may be connected to the conduit 22. In installations where there is a water main, such as the water main 26 of FIG. 1, there may be provided a water conduit 31, but where a water main is not available, a tank of water may be provided on the platform 83, suitably pressurized from the pressurized air tank 89.

Also on the platform is the fuel tank 11, as of propane, with conduit 12, and valve 13, 14 and 15, connected by a connector 29 to the air conduit 28.

The embodiment of the fluid supply system as shown in FIG. 4 will be understood to be adapted for different tasks, and in accordance with the fluids desired to be supplied. It is particularly suited for installations, such as hog farms, dairy farms, zoos, and the like, where there is no source of compressed air. It is also adaptable to be used where there is neither air nor water, by the provision of a tank for water, as above noted. As will be understood, additional tanks may be provided for additional substances, as may be required by particular circumstances.

It will be obvious to those skilled in the art that various changes may be made without departing from the spirit of the invention, and therefore the invention is not limited to what is shown in the drawings and described in the specification but only as indicated in the appended claims.

I claim:

1. A steam generating and discharging machine comprising in combination, a hand-held steam generator unit and a fluid supply system therefor, (a) said hand-held steam generator unit comprising:

(i) means for producing heat solely by combustion including a substantially closed combustion chamber of heat conducting material having an exhaust pipe extending therefrom, said exhaust pipe having a free open end spaced from said combustion chamber, (ii) means remote from said exhaust pipe for admitting a combustible fluid mixture to said combustion chamber, (iii) a jacket having a closed end in spaced surrounding relationship to said combustion chamber, and including a steam discharge pipe surrounding said exhaust pipe and having a free end extending beyond said free end of said exhaust pipe, (iv) means extending into said combustion chamber for igniting said combustible mixture therein, and (v) means for admitting water to said jacket remote from said steam discharge pipe, (vi) whereby combustion gasses from said combustion chamber discharge from said exhaust pipe open end and into said steam discharge pipe and mixing with said water and steam, therein, prior to discharge from said steam discharge pipe, (b) said fluid supply system comprising means for producing said combustible fluid mixture including:

(i) means for storing a supply of fluid fuel, (ii) means for supplying oxygen-containing fluid, (iii) means for mixing said fluids to produce said combustible fluid mixture, (iv) means comprising flexible conduit means for connecting said mixing means and said combustible fluid mixture admitting means, and (c) said fluid supply means further comprising water supplying conduit means comprising flexible conduit means connected to said water admitting means.

2. The machine as set forth in claim 1, wherein said mixture igniting means includes electric potential generating means.

3. The combustion of claim 1, said means for supplying oxygen-containing fluid comprising means for connection to a source of air under pressure.

4. The combination of claim 1, wherein said fluid fuel storing means comprises fluid fuel tank means including an outlet conduit therefrom having therein a control valve, a pressure regulating valve and a check valve, and means connecting said outlet conduit to said mixing means.

5. The combination of claim 1, said water supplying conduit means having means at one end for connection to said water admitting means, means at the other end for connection to a source of water under pressure, and control valve means for controlling the flow through said water supplying conduit means.

6. The combination of claim 1, said unit comprising detergent admitting means connected to said steam discharge pipe beyond the free end of said exhaust pipe, and means supplying detergent to said detergent admitting means comprising flexible conduit means.

7. The combination of claim 6, said detergent supplying means comprising closed detergent tank means having air pressure inlet means and detergent outlet means, conduit means connecting said air pressure inlet means and a source of air under pressure, and said last mentioned flexible conduit means connecting said detergent outlet means and said detergent admitting means.

8. The combination of claim 7, said means for supplying oxygen-containing fluid comprising air conduit means having means at one end for connection to a source of air under pressure.

9. The combination of claim 8, said water supplying flexible conduit means having means at one end for connection to said water admitting means, means at the other end for connection to a source of water under pressure, and control valve means for controlling the flow through said water supplying conduit means.

10. The combination of claim 9, said unit further comprising handle means for support thereof by the hand of an operator.

11. The combination of claim 9, and valve means for controlling the flow of said air and valve means for controlling the flow of said detergent.

12. A hand-held steam generating and discharging unit comprising:

(a) a water jacket having a closed end, (b) steam discharge pipe connected to said water jacket, (c) means remote from said discharge pipe for supplying water to said water jacket comprising an inlet to said water jacket and flexible conduit means connected to said inlet, (d) means for producing heat solely by combustion comprising means defining a combustion chamber substantially within said water jacket for receiving heat from combustion therein and for transferring heat to water within said water jacket and comprising an imperforate heat conducting wall exposed to combustion products on the inner side and to water on the outer side thereof, said wall having an inlet, an outlet and an igniter mounting means, (e) igniter means extending into said igniter mounting means to ignite combustion gases within said chamber, (f) an exhaust pipe extending from the outlet of said combustion chamber wall and having a free end extending within said outlet pipe such that combustion gases from said chamber exhaust pipe mix with water or steam prior to discharge from said steam discharge pipe, and (g) means to supply a combustible fluid fuel to said combustion chamber through said inlet to said combustion chamber defining means and flexible conduit means connected to said inlet (h) and an inlet opening in said steam discharge pipe substantially downstream of said free end of said exhaust pipe adaptable to allow an additional fluid to be added to said combustion gases and said steam or water mixture.

13. The hand-held steam generating and discharging unit of claim 12, and handle means connected to said water jacket for supporting said unit.

14. The hand-held steam generator discharging unit of claim 12, said igniter mounting means extending through said water jacket.

15. The hand-held steam generator discharging unit of claim 12, further wherein said mixture igniting means includes electric potential generating means.

16. The hand-held steam generator discharging unit of claim 12, said water jacket closed end being remote from said outlet pipe, said combustion chamber having a closed end remote from said exhaust pipe, said ends being in spaced apart relationship.

* * * * *